US009918563B1

(12) United States Patent
Lockett

(10) Patent No.: US 9,918,563 B1
(45) Date of Patent: Mar. 20, 2018

(54) PORTABLE DIAPER CHANGING TABLE

(71) Applicant: Anthony Lockett, Fort Worth, TX (US)

(72) Inventor: Anthony Lockett, Fort Worth, TX (US)

( * ) Notice: Subject to any disclaimer, the term of this patent is extended or adjusted under 35 U.S.C. 154(b) by 0 days.

(21) Appl. No.: 15/059,473

(22) Filed: Mar. 3, 2016

Related U.S. Application Data

(60) Provisional application No. 62/127,597, filed on Mar. 3, 2015.

(51) Int. Cl.
*A47D 5/00* (2006.01)

(52) U.S. Cl.
CPC ..... *A47D 5/00* (2013.01)

(58) Field of Classification Search
CPC ..... A47D 5/00; A45F 3/04; A45C 2003/007; A45C 13/02; A45C 3/00; A45C 7/0095
USPC ..... 224/156
See application file for complete search history.

(56) References Cited

U.S. PATENT DOCUMENTS 4,068,786 A * 1/1978 Taniguchi ..... A45C 9/00 150/108
4,859,084 A * 8/1989 Kaumeyer ..... A45C 3/00 190/903
5,544,792 A * 8/1996 Arnwine ..... A45C 7/0086 224/153
5,649,658 A * 7/1997 Hoffman ..... A45F 3/04 190/2
6,193,034 B1 * 2/2001 Fournier ..... A45C 7/0095 190/107
6,213,304 B1 * 4/2001 Juliussen ..... A45C 3/00 206/581
6,298,993 B1 * 10/2001 Kalozdi ..... A45C 3/00 150/106
6,390,260 B1 * 5/2002 Roegner ..... A45C 3/00 190/1
6,694,552 B1 * 2/2004 Vickers ..... A47D 5/006 5/655
7,891,034 B2 * 2/2011 Smith ..... A47D 5/003 5/655
8,490,230 B2 * 7/2013 Rovin ..... A47D 5/006 190/2
8,732,873 B2 * 5/2014 Iskowitz ..... A47D 5/00 5/118
8,973,757 B2 * 3/2015 Fimbrez ..... A45C 9/00 190/2
9,125,477 B2 * 9/2015 Killion ..... A45F 4/12
9,144,290 B1 * 9/2015 Hall ..... A45F 4/00
(Continued)

*Primary Examiner* — Peter Helvey
(74) *Attorney, Agent, or Firm* — Eldredge Law Firm; Richard G. Eldredge

(57) ABSTRACT

A portable changing table includes a body a shoulder strap secured to the body, the strap is configured to receive a shoulder of a user for carrying the body; and an attachment device secured to the shoulder strap, the attachment device is configured to secure the shoulder strap to a structure. The body includes a first compartment configured to store changing supplies and a second compartment. The second compartment includes a rigid elastic material configured to receive an infant thereon, the rigid elastic material being pivotally attached to the body about a pivot joint; a fastening strap extending from a top surface of the rigid elastic material, the fastening strap is configured to secure the infant to the top surface to prevent rolling; and a lip extending from the top surface of the rigid elastic material, the edge is configured to prevent rolling.

2 Claims, 3 Drawing Sheets

(56) References Cited

U.S. PATENT DOCUMENTS

| | | | | |
|---|---|---|---|---|
| 9,301,623 | B2 * | 4/2016 | Herdman | A47D 5/00 |
| 9,445,672 | B2 * | 9/2016 | Demosthene | A47C 7/62 |
| 2002/0074251 | A1 * | 6/2002 | Hirshberg | A45C 9/00 206/315.1 |
| 2006/0289582 | A1 * | 12/2006 | Killilea | A47D 5/006 224/577 |
| 2007/0119883 | A1 * | 5/2007 | Albritton | A45C 3/00 224/153 |
| 2010/0051659 | A1 * | 3/2010 | Ferrari | A45F 3/04 224/197 |
| 2011/0314608 | A1 * | 12/2011 | Rovin | A47D 5/006 5/655 |
| 2012/0031943 | A1 * | 2/2012 | Koutouras | A45C 13/02 224/653 |
| 2012/0312850 | A1 * | 12/2012 | Killion | A45F 4/12 224/576 |
| 2013/0341367 | A1 * | 12/2013 | Purpura | A45F 4/06 224/156 |
| 2014/0158737 | A1 * | 6/2014 | Koutouras | A45C 13/02 224/653 |
| 2014/0374305 | A1 * | 12/2014 | Fimbrez | A45C 9/00 206/581 |
| 2015/0083764 | A1 * | 3/2015 | Houston | A45C 9/00 224/156 |
| 2016/0360862 | A1 * | 12/2016 | Camacho | A45F 3/02 |

* cited by examiner

PORTABLE DIAPER CHANGING TABLE

BACKGROUND

1. Field of the Invention

The present invention relates generally to devices used in changing diapers, and more specifically, to a portable diaper changing table.

2. Description of Related Art

Diaper changing tables, are well known in the art and are effective in holding an infant while a diaper is being changed. In one exemplary embodiment, as shown in FIG. 1, a conventional public diaper changing table 101 is secured to a wall of a building and includes the features of a stationary body 103 that secures to a wall or object and a hinged body 105 that is operably connected to stationary body 101. During use, the user operably opens hinged body 105 and places an infant on top surface of the body 105 thereon for diaper changing purposes.

A common disadvantage with diaper changing table 101 is inconsistency and lack of assurance that a restroom or place of business will provide such a table for use which in turn results in a frantic search for a suitable location to perform the needed task.

Another common disadvantage associated with table 101 is that the table can be unsanitary and is suspect to have germs from public use which in turn could result in the user or the users' infant contracting sicknesses.

Although great strides have been made in the area of diaper changing tables, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
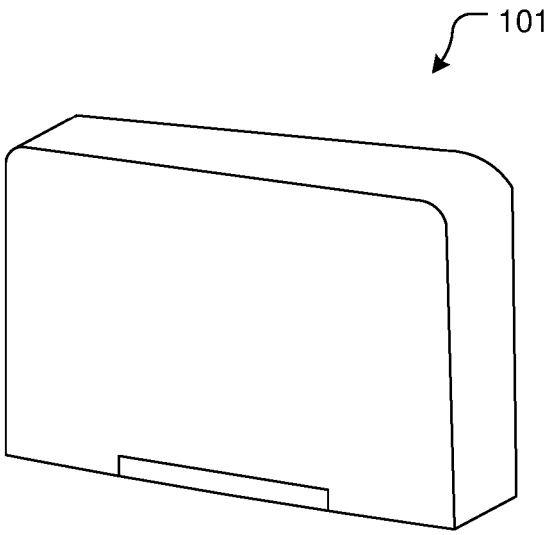
FIG. 1A (Prior Art)
FIG. 1A is a perspective view of a conventional public diaper changing table in a closed position.
Figure 1B:
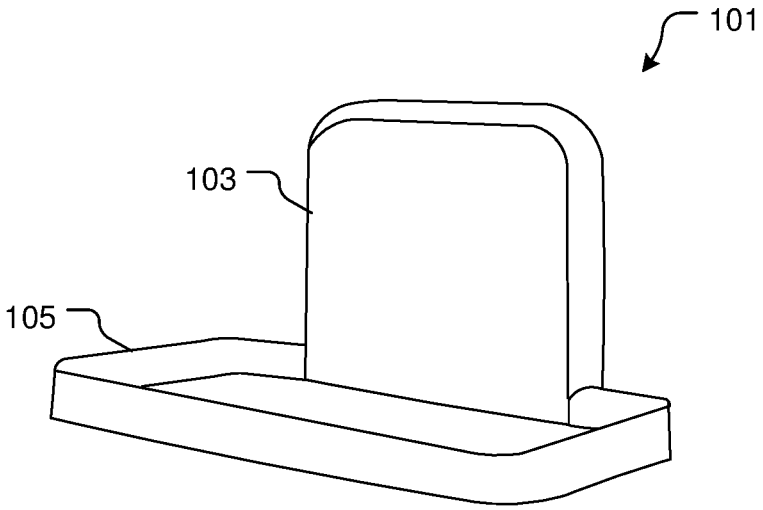
FIG. 1B (Prior Art)
FIG. 1B is a perspective view of the conventional public changing table in an open position.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional public diaper changing tables. Specifically, the system of the present application is configured such that a sanitary diaper changing table is conveniently available wherever and whenever it is needed. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2A:
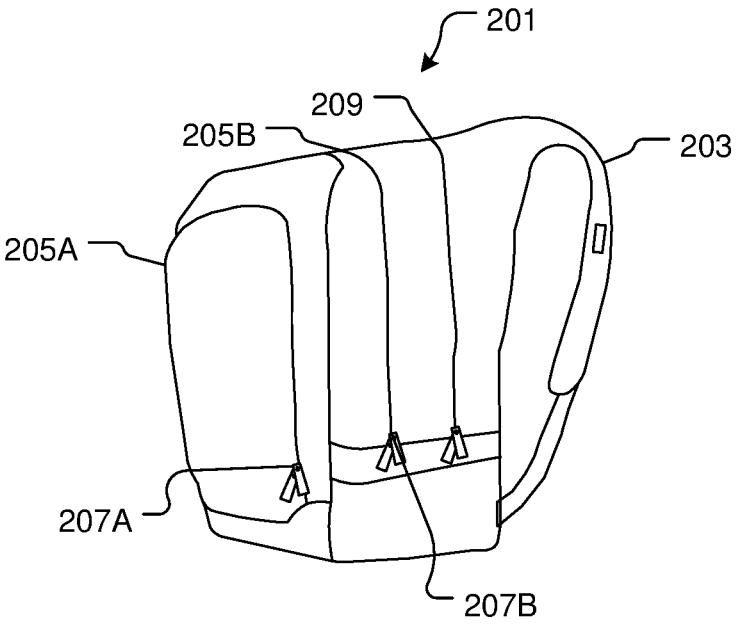
FIG. 2A is a perspective view of a portable diaper changing table in the form of a backpack in accordance with a preferred embodiment of the present application.
Figure 2B:
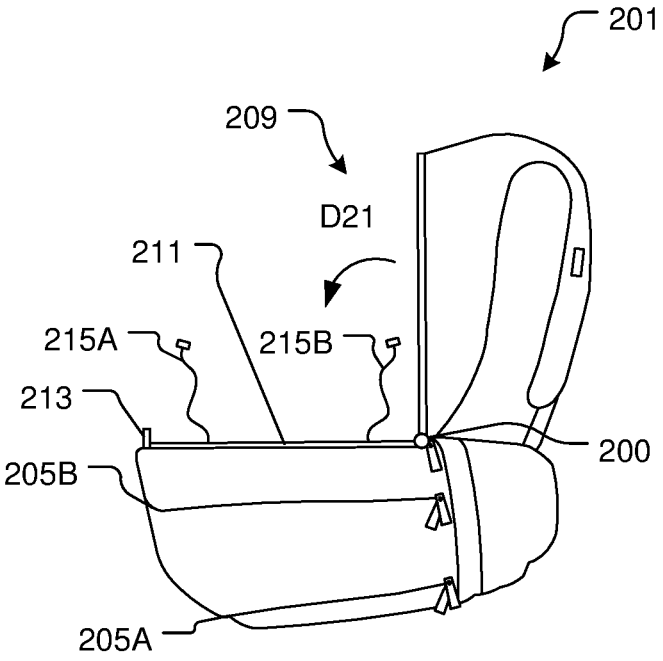
FIG. 2B is a side view of the portable diaper changing table in operable form in accordance with a preferred embodiment of the present application.

Referring now to the drawings wherein like reference characters identify corresponding or similar elements throughout the several views, FIGS. 2A and 2B depict a perspective view and side view, respectively, of a portable diaper changing table 201 in the form of a backpack in accordance with a preferred embodiment of the present application. It will be appreciated that the portable diaper changing table 201 overcomes one or more of the above-listed problems commonly associated with conventional public diaper changing tables.

In the contemplated embodiment, changing table 201 includes one or more carrying straps 203 which can be used to comfortably transport the portable changing table wherever it is needed. As depicted in the contemplated embodiment, portable changing table 201 also contains compartments 205A and 205B in which baby care items and cleaning items can be stored. Compartments 205A and 205B may be operably opened and closed using zipper mechanisms 207A, 207B so that items can be securely contained within the compartments.

In one contemplated embodiment, it will be appreciated that portable changing table 201 will contain at least one compartment 209 where the changing table 211 is contained. In the contemplated embodiment, changing table 211 pivots from straps 203 in direction D21 about a pivot joint 200 from a closed position, as shown in FIG. 2A to an open position as shown in FIG. 2B.

As depicted in FIG. 2B, compartment 209 is opened to expose changing table 211 on which an infant can securely lay while such actions as diaper changing can occur. It will be appreciated that the changing table 211 may include a lip 213 that extends from table surface 211 that allows the infant to safely rest on table 211 without rolling off. Safety straps 215A, 215B may also be used to secure the infant to table 211 while the diaper changing process is performed. In the contemplated embodiment, the safety straps 215A, 215B are secured to a top surface of the changing table 211. In the preferred embodiment, the table 211 is composed of a rigid elastic material, which can be contoured in shape to prevent rolling.

Accordingly, one of the unique features believed characteristic of the present application is the ability for changing table 201 to reasonably and safely hold the weight of an infant as it is secured to a protruding surface 305.

Figure 3:
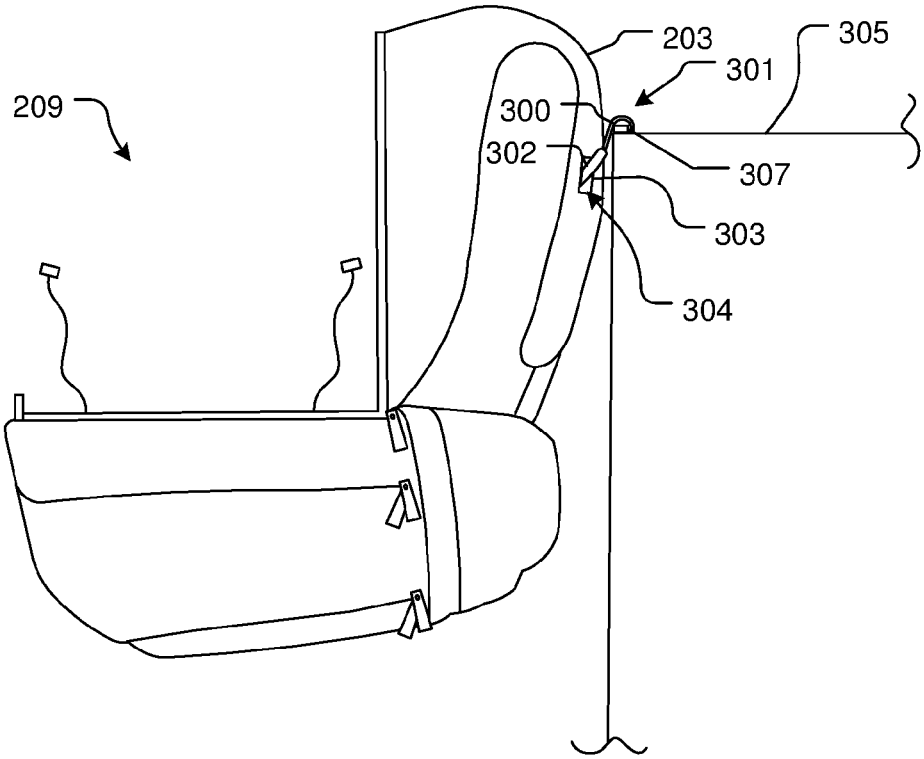
FIG. 3 is a side view of a portable diaper changing table in operable form in accordance with an alternative embodiment of the present application.

Referring now to FIG. 3 an alternative embodiment of portable changing table 201 is shown having an attachment device 301 secured to one or more straps 203. During use, the attachment device is configured to secure the straps 203 to a structure 305 such as a counter top or table. In one embodiment, a hidden compartment 303 could secure the attachment device 301 to the straps 303. In the exemplary embodiment, the hidden compartment forms an opening that provides access to a cavity 304 disposed within the strap 203 and configured to store the attachment device 301 therein.

In one contemplated embodiment, the attachment device 301 comprises of a hook 300 secured to a bungie strap 302 configured to retract within compartment 303. Accordingly, the attachment device 301 allows the user to engage with a structure for holding the changing table during use, while also retracting within the compartment for ease of travel. It will be appreciated that other types of attachment devices are also contemplated, for example, a hook-loop fastener, strap with clip, and other types of similarly suitable devices.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A portable changing table, comprising:

a body, having:

a first compartment forming a first inner enclosed area to store changing supplies therein;

a first zipper mechanism configured to close the first compartment;

a second compartment adjacent to the first compartment, the second compartment forming a second inner enclosed area and having:

a changing table wholly contained within the second area of the second compartment and configured to lie in a substantially flat position when the second compartment is opened, the changing table composed of a rigid plastic material configured to receive an infant thereon, the changing table having;

a fastening strap extending from a top surface of the changing table, the fastening strap is configured to secure the infant to the top surface to prevent rolling; and a rigid lip extending from the top surface of the changing table, the lip is configured to prevent rolling; and a second zipper mechanism configured to close the second compartment;

wherein the changing table is pivotally and permanently attached to the body about a pivot joint;

wherein the changing table and the second compartment have substantially a same length; and wherein the second compartment is positioned to rest between the changing table and a surface when in an open position, thereby elevating the changing table from the surface;

a shoulder strap secured to the body, the strap is configured to receive a shoulder of a user for carrying the body, the shoulder strap having a thickness;

a hidden compartment disposed within the thickness of the shoulder strap;

an attachment device positioned within the hidden compartment of the shoulder strap, the attachment device is configured to secure the shoulder strap to a structure, the attachment device having:

a bungie strap configured to fit within the hidden compartment.

2. The portable changing table of claim 1, the attachment device further comprising:

a hook secured to the elastic strap, the hook being configured to engage with an edge of the structure.

* * * * *